US006155786A

United States Patent [19]

Blateri et al.

[11] Patent Number: 6,155,786

[45] Date of Patent: Dec. 5, 2000

[54] CEILING FAN ASSEMBLY AND METHOD FOR ASSEMBLING SAME

[75] Inventors: Frank Blateri, Coppell, Tex.; Wang Liang Chou, Taichung, Taiwan

[73] Assignee: Aloha Housewares Co., LTD, Taiwan, China

[21] Appl. No.: 09/334,976

[22] Filed: Jun. 17, 1999

[51] Int. Cl.[7] ..... F01D 5/30

[52] U.S. Cl. ..... 416/206; 416/210 R; 416/207; 416/214 R

[58] Field of Search ..... 416/210 R, 5, 416/204 R, 205, 206, 207, 214 R, 220 A, 221; 403/381, 319

[56] References Cited

U.S. PATENT DOCUMENTS

| | | | |
|---|---|---|---|
| D. 347,056 | 5/1994 | Bucher et al. . | |
| D. 360,942 | 8/1995 | Bucher et al. . | |
| D. 376,641 | 12/1996 | Bucher . | |
| 4,746,271 | 5/1988 | Wright . | |
| 4,850,799 | 7/1989 | Bucher, Sr. et al. . | |
| 5,302,083 | 4/1994 | Bucher et al. . | |
| 5,304,037 | 4/1994 | Scofield . | |
| 5,458,463 | 10/1995 | Chiang . | |
| 5,486,094 | 1/1996 | Davis, Jr. et al. . | |
| 5,542,819 | 8/1996 | Bucher et al. . | |
| 5,873,701 | 7/1999 | Shiu | 416/205 |
| 5,927,945 | 7/1999 | Chen | 416/5 |
| 5,951,197 | 9/1999 | Wu | 403/315 |
| 6,027,310 | 2/2000 | Kerr, Jr. et al. | 416/210 R |
| 6,042,339 | 3/2000 | Blateri et al. | 416/219 A |

*Primary Examiner*—Edward K. Look
*Assistant Examiner*—James M McAleenan
*Attorney, Agent, or Firm*—Haynes and Boone LLP

[57] ABSTRACT

A fan assembly and a method of assembling same according to which a mounting flange is provided on an arm to which a blade is connected and a slot is provided in a mounting ring. The flange extends in the slot, and a retainer engages the arm member. The retainer and the mounting ring are attached the end casing and a post is provided in the slot for extending in a bore formed in the flange.

52 Claims, 2 Drawing Sheets

CEILING FAN ASSEMBLY AND METHOD FOR ASSEMBLING SAME

BACKGROUND

This disclosure relates to a ceiling fan assembly and a method for assembling same, and, more particularly, to such an assembly and method in which the fan blades can be attached to the fan motor relatively easily and quickly using a minimum number of parts.

Rotating fans that are mounted to the ceilings of homes and businesses are very popular. These types of fans consist of an electric motor mounted to the ceiling and a plurality of angularly-spaced blades. The blades are usually mounted to a rotor end casing of the motor by a plurality of mounting arms. However, it is difficult and time-consuming to mount the blades since a relatively large number of fasteners, or the like, are normally used to attach each blade to its corresponding arm, and each arm to the rotor end casing. Since there are usually five blades and arms, the labor costs involved in assembling and mounting the complete fan assembly constitute a very high percentage of the overall cost of the assembly. This difficultly in assembly is compounded by the fact that the rotor end casing of the fan motor is initially mounted to the ceiling, and the above-mentioned arms and blades often have to be mounted to the end casing in its elevated position which is awkward and difficult.

Therefore, what is needed is a fan assembly and a method of assembling same in which the arms can be easily and quickly attached to the rotor end casing of the fan motor, without the use of fasteners, or the like, and even when the end casing is mounted to the ceiling.

SUMMARY

An embodiment of the present invention, accordingly, is directed to a ceiling fan assembly and method for assembling same according to which a mounting flange is provided on an arm to which a blade is connected. A mounting ring is provided having a slot for receiving the flange and a retainer engages the arm member. The retainer and the mounting ring are attached the end casing.

Several advantages result from this arrangement. For example, the arm is connected to the mounting ring with a minimum of effort and without any fasteners. Also, the retainer is secured in place by the same fasteners that fasten the mounting ring to the end casing. Thus, the use of a large number of nuts, bolts and screws is eliminated and the fan assembly can be assembled and mounted relatively easily and quickly thus considerably reducing the labor costs.

BRIEF DESCRIPTION OF THE DRAWINGS

FIG. 1 of the drawings depicts the fan assembly of an embodiment of the present invention which assembly is referred to, in general, by the reference numeral 10 and which includes a housing 12 connected to a ceiling of a building by a mounting rod 14. It is understood that the mounting rod 14 is connected to the ceiling in any known manner, and that electrical conductors extend from an electrical box (not shown) mounted to the ceiling, through the rod, and into the interior of the housing 12. A conventional electrical motor is provided in the housing 12 that includes a stator (not shown) and a rotor that includes an end casing 16 that protrudes downwardly through an opening in the lower surface of the housing, as viewed in FIG. 1. A mounting ring 18, which will be described in detail later, is mounted to the exposed end of the end casing 16.

Figure 1:
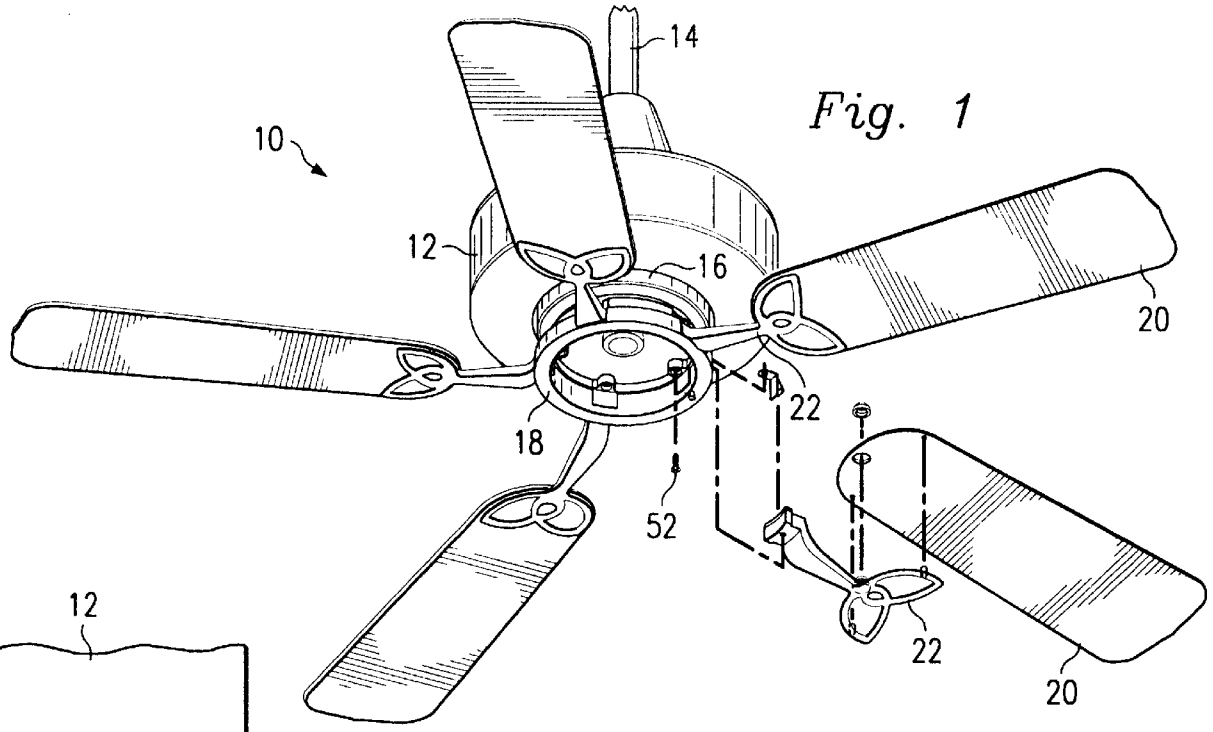
FIG. 1 is an isometric, partially exploded, view of the fan assembly of an embodiment of the present invention.

Five elongated blades, one of which is shown by the reference numeral 20, are respectively mounted to five arms, one of which is shown by the reference numeral 22. The arms 22, and therefore the blades 20, are angularly spaced around the mounting ring 18 and are secured thereto in a manner to be described.

Figure 2:
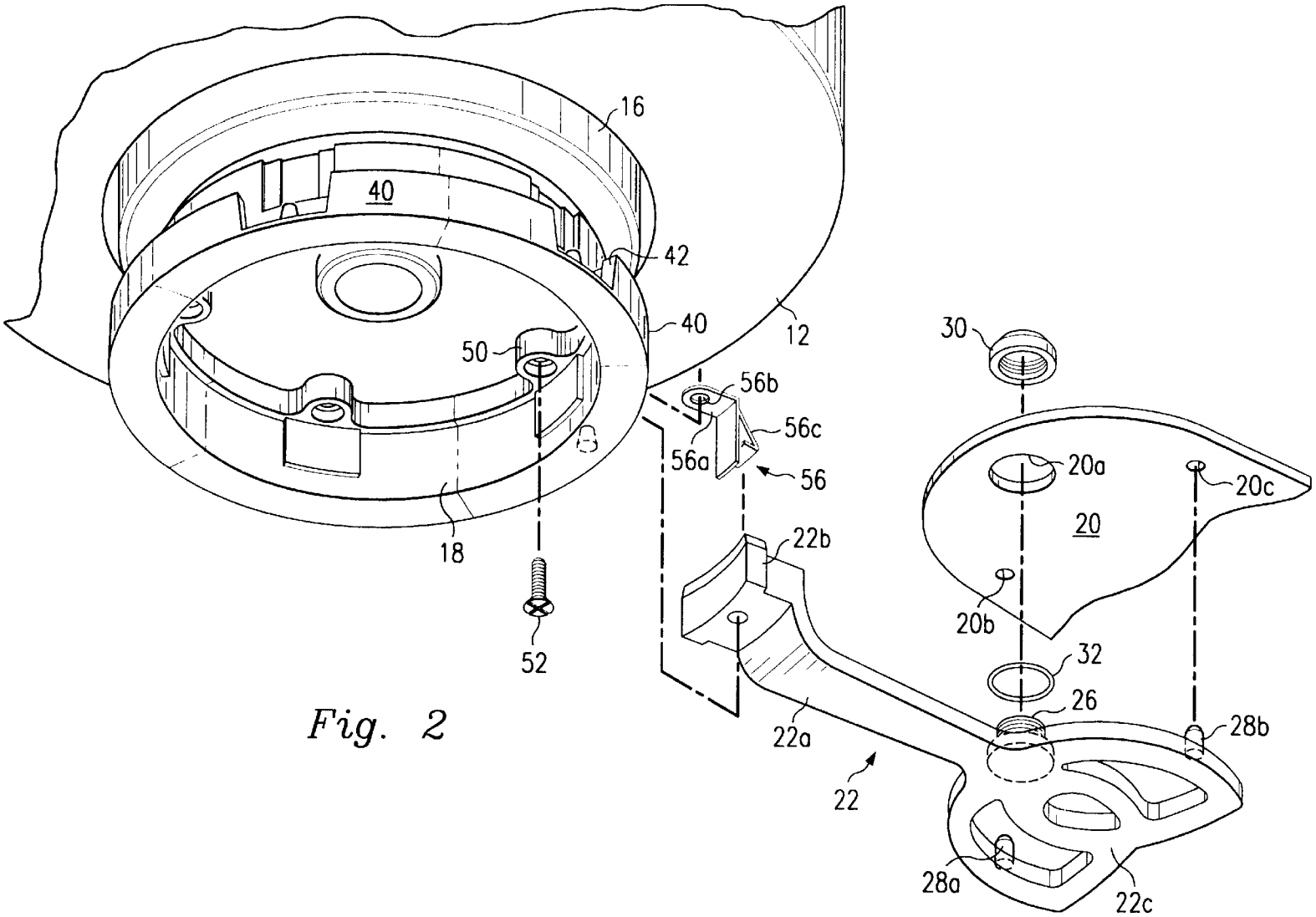
FIG. 2 is an enlarged, isometric, partial exploded view of the assembly of FIG. 1, depicting one fan blade and its associated arm.

One arm 22, and its corresponding blade 20, are shown in FIG. 2. The arm 22 includes an intermediate portion 22*a* that extends between a mounting flange 22*b*, formed at one end of the arm, and a relatively wide mounting portion 22*c* formed at the other end thereof.

The intermediate portion 22*a* of the arm 22 is curved upwardly, as viewed in FIG. 2, towards the flange 22*b*, and the latter flange extends perpendicularly to the axis of the arm 22. The mounting portion 22*c* of the arm 22 has a relatively large opening extending therethrough to reduce its weight.

A externally threaded post 26 and two guide pins 28*a* and 28*b* extend and 22*c*, as well as the mounting flange 22*b*, the post 26, and the guide pins 28*a* and 28*b*, are all molded integrally.

The corresponding end of the blade 20 has an enlarged opening 20*a* extending therethrough for receiving its corresponding post 26, and two other openings 20*b* and 20*c* for receiving the guide pins 28*a* and 28*b*, respectively. An internally threaded cap 30 threadedly engages the distal end of the post 26 to retain the blade 20 to the arm 22, and a seal ring 32 extends between the lower outer surface of the post 26 and the inner wall of the cap 36. Further details of the post 26 will be describe later.

As shown generally in FIG. 2, the mounting ring 18 has an annular flange 40 extending from its outer lower surface and formed integrally therewith. Five notches, or slots, one of which is shown by the reference numeral 42, are formed in the outer surface of the flange 40. The slots 42 are angularly spaced around the circumference of the flange 40 at equal intervals.

Figure 3:
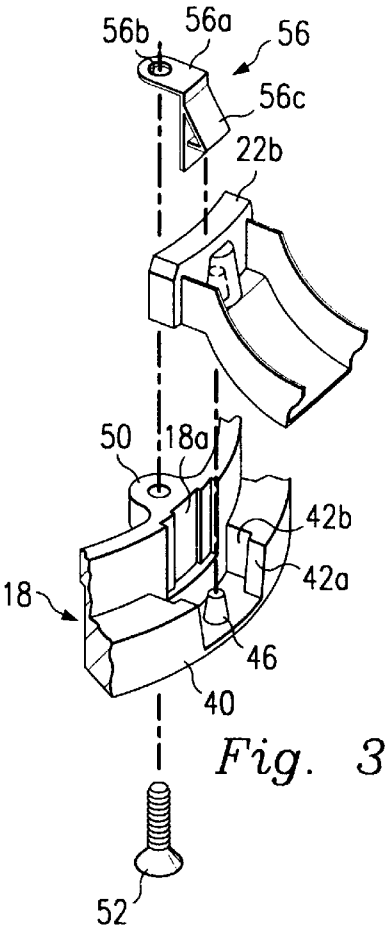
FIG. 3 is an enlarged isometric, partial exploded view depicting the connection between the arm and the mounting ring of FIG. 2.

FIG. 3 depicts, in detail, the portion of the flange 40 in which the slot 42 is formed. The slot 42 is stepped from a relatively narrow portion 42*a* extending flush with the outer surface of the flange 40 to a wider portion 42*b* radially inwardly from the portion 42*a*. The width of the slot portion 42*b* substantially corresponds to the width of the flange 22*b* of the arm 22 and receives the mounting flange with the arm portion 22*a* extending through the slot portion 42*a*. A post 46 is formed in the slot 42 and is preferably formed integrally with the flange 40 by machining from the same stock. A corresponding bore 22*d* (FIG. 2) is formed in the underside of the mounting flange 22*b* which receives a corresponding post 46.

As shown in FIG. 2, five radially-extending bosses, one of which is shown by the reference numeral 50, are angularly spaced around the inner surface of the flange 40 at equal intervals in alignment with the slots 42, respectively. Each boss 50 has a through opening 50*a* formed therethrough and five bolts, one of which is shown by the reference numeral 52, respectively extend through the latter openings. The bolts 52 also extend into five, angularly-spaced, threaded bores (not shown), respectively, formed in the lower surface of the end casing 16 to attach the mounting ring 18 to the end casing.

Referring to FIGS. 2 and 3, a retainer member, in the form of a spring clip 56 is provided to retain the mounting flange 22*b* in the slot 42*a*. The spring clip 56 has an L-shaped portion 56*a*, one leg of which has a through opening 56*b* through which a corresponding bolt 52 extends to mount the clip between the mounting ring 18 and the end casing 16. The other leg of the clip portion 56*a* extends in a slot 18*a* (FIG. 3) formed in the outer surface of the mounting ring 18. The spring clip 56 also has a flexible, angularly-extending portion 56*c* that is bent back to define a surface that engages the upper surface of its corresponding mounting flange 22*b* as shown in FIG. 4, to retain the mounting flange in its corresponding slot 42*b*.

Figure 4:
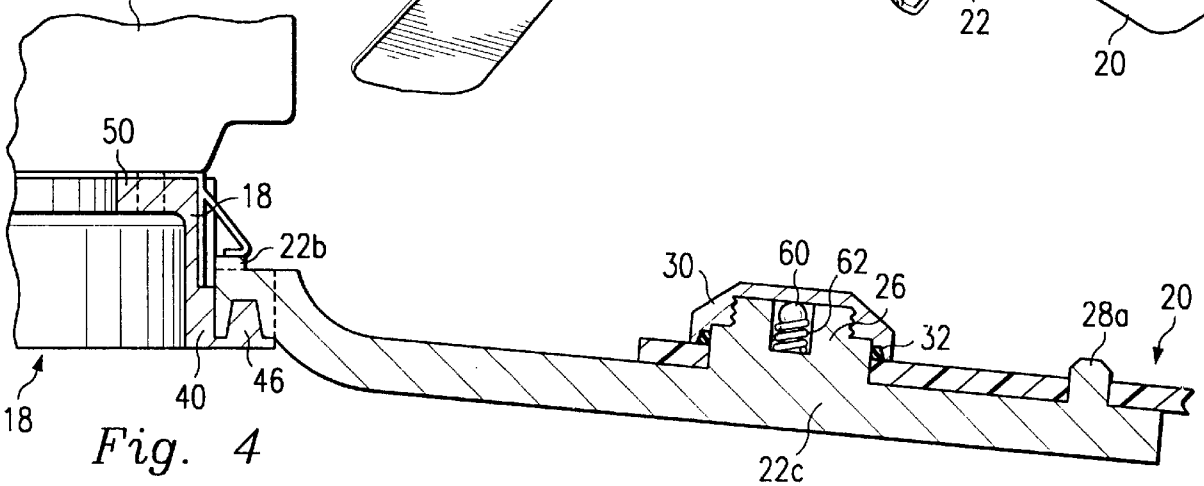
FIG. 4 is a partial sectional view of the assembly of FIG. 2 in an assembled condition.

As also shown in FIG. 4, a counter bore is provided in the post 26 which receives a ball 60, and a spring 62 extends between the ball and the bottom of the counter bore to urge the ball upwardly, as viewed in FIG. 4, to tighten the threaded connection between the cap 30 and the post 26, and therefore between the blade 20 and the arm 22.

Since the other four blades 20 and arms 22 are identical to the blade and arm described above, and are mounted to the mounting ring 18 in the same manner, they will not be described in detail.

The fan assembly 10 is normally shipped with the mounting ring 18 and the spring clips 56 mounted to the rotor end casing 16. To mount the fan assembly 10 to a ceiling, the rod 14 (FIG. 1) is connected to the ceiling in any known manner, and the housing 12 is connected to the rod, with the lower portion of the end casing 16, and therefore the mounting ring 18, protruding downwardly from the lower end of the housing 12 as shown in FIG. 1.

Each blade 20 is attached to its corresponding arm 22 by placing the blade over the mounting portion 22*c* of its corresponding arm, with the post 26 of the arm extending in the opening 20*a* (FIG. 2) of the blade, and with the guide pins 28*a* and 28*b* extending in the blade openings 20*b* and 20*c* respectively. Each cap 30 is then threaded over its corresponding post 26, with the corresponding seal ring 32 therebetween, to secure each blade 20 to its respective arm 22.

The mounting flange 22*b* of each arm 22 is then placed over its corresponding slot 42*b* (FIG. 3) in the mounting ring 18 with the bore 22*d* of the arm aligned with the corresponding post 46. The flange 22*b* is then lowered into the slot 42*b* and over the post 46 with the corresponding end portion of the arm 22 extending through the slot 42*a*. During this movement, the angular portion 56*a* of the corresponding spring clip 56 is biased radially inwardly and then snaps back out to the position shown in FIG. 4 when the flange 22*b* reaches the bottom of slot 42. In this latter position, the bent-back portion of each clip portion 56*c* engages the upper surface of its corresponding flange 22*b* to retain the arms 22 to the mounting ring 18.

As a result of the foregoing, the arms 22 are connected to the mounting ring 18 with a minimum of effort and without any fasteners. Also, each blade 22 is connected to its respective arms 20 with only one fastener-the cap 30. Further, the spring clips 56 are secured in place by the same fasteners 52 that fasten the mounting ring 18 to the end casing 16. Still further, the posts 46 guide and stabilize the mounting flanges 22*b* in their respective slots 42*a*.

Thus, the use of a large number of fasteners is eliminated, and the fan assembly can be assembled and mounted relatively easily and quickly thus considerably reducing the labor costs.

According to an alternate embodiment, the mounting ring 40 can be formed of a plurality of arcuate segments connected together in any known manner. The respective ends of the latter segments are shown by the phantom lines on the ring 40 in FIG. 2 and are assembled to the end casing 16 in the same manner as the ring, as discussed above.

It is understood that variations may be made in the foregoing without departing from the scope of the invention. For example, the mounting flanges can be provided on the mounting ring and the corresponding slots provided on the mounting arm. Further, some of the components discussed above are described as being formed integrally with other components for the purpose of example only, it being understood that they may be formed separately and attached to the other components in any known manner. Still further, the spatial references, such as "upper", "lower", "radially inwardly", "angularly-spaced", etc., are for the purpose of illustration only and do not limit the specific orientation, shape or location of the structure described above.

It is understood that other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fan assembly comprising a rotor end casing, a mounting ring having at least one slot formed therein, an arm member having a flange member for inserting into the slot, a spring clip for engaging the arm member to retain it in the slot and having a through opening, and a fastener for connecting the mounting ring to the end casing, the fastener extending through the opening to also connect the spring clip to the casing.

2. The assembly of claim 1 wherein the spring clip engages the upper surface of the flange member.

3. The assembly of claim 2 wherein the mounting ring has an opening extending therethrough and wherein the fastener extends through the opening in the first portion of the retainer and through the opening in the mounting ring and into the end casing.

4. The assembly of claim 1 wherein the mounting ring has at least one post formed therein and located in the slot and wherein the flange member has an opening for receiving the post.

5. The assembly of claim 1 wherein there are a plurality of angularly-spaced slots formed in the mounting ring and a plurality of arm members having flange members for respectively extending in the slots.

6. The assembly of claim 5 further comprising a plurality of blades respectively connected to the arm members.

7. The assembly of claim 5 wherein there are a plurality of spring clips respectively engaging the arm members.

8. The assembly of claim 1 wherein the spring clip comprises a first portion extending in the slot and adapted to be biased inwardly during the insertion of the flange member in the slot and then snap outwardly to engage the flange member and retain the arm member in the slot.

9. The assembly of claim 1 wherein the mounting ring comprises a plurality of interconnected arcuate segments.

10. A fan assembly comprising a rotor end casing, a mounting ring having at least one slot formed therein and at least one post formed thereon and located in the slot, an arm member having a flange for inserting into the slot and having an opening for receiving the post, a retainer for engaging the arm member to retain it in the slot, and a fastener for connecting the mounting ring and the retainer to the end casing.

11. The assembly of claim 10 wherein the retainer is in the form of a spring clip having a through opening for receiving the fastener.

12. The assembly of claim 11 wherein a portion of the spring clip engages the upper surface of the flange.

13. The assembly of claim 12 wherein the mounting ring has an opening extending therethrough and wherein the fastener extends through the openings in the mounting ring and the spring clip and into the end casing.

14. The assembly of claim 10 wherein there are a plurality of angularly-spaced slots formed in the mounting ring, and a plurality of arm members having flanges for respectively extending in the slots.

15. The assembly of claim 14 further comprising a plurality of blades respectively connected to the arm members.

16. The assembly of claim 14 wherein there are a plurality of retainers respectively engaging the arm members.

17. The assembly of claim 10 wherein the retainer is in the form of a spring clip having a portion extending in the slot and adapted to be biased inwardly during the insertion of the flange in the slot and then snap outwardly to engage the flange and retain the arm member in the slot.

18. The assembly of claim 10 wherein the mounting ring comprises a plurality of interconnected arcuate segments.

19. The assembly of claim 18 wherein each arcuate segment has a slot formed therein.

20. A fan assembly comprising a rotor end casing, a mounting ring having at least one slot formed therein, an arm member having a flange for inserting into the slot, a spring clip extending in the slot and adapted to be biased inwardly during the insertion of the flange in the slot and then snap outwardly to engage the flange and retain the arm member in the slot, and a fastener for connecting the mounting ring and the retainer to the end casing.

21. The assembly of claim 20 wherein the spring clip has an opening for receiving the fastener.

22. The assembly of claim 21 wherein a portion of the spring clip engages the upper surface of the flange.

23. The assembly of claim 22 wherein the mounting ring has an opening extending therethrough and wherein the fastener extends through the openings in the spring clip and the mounting ring and into the end casing.

24. The assembly of claim 20 wherein the mounting ring has at least one post formed therein and located in the slot and wherein the flange has an opening for receiving the post.

25. The assembly of claim 20 wherein there are a plurality of angularly-spaced slots formed in the mounting ring, and a plurality of arm members having flanges for respectively extending in the slots.

26. The assembly of claim 25 further comprising a plurality of blades respectively connected to the arm members.

27. The assembly of claim 25 wherein there are a plurality of spring clips respectively engaging the arm members.

28. The assembly of claim 20 wherein the mounting ring comprises a plurality of interconnected arcuate segments.

29. A fan assembly comprising a rotor end casing, a mounting ring having at least one slot formed therein, at least one post located in the slot, an arm member having a flange for inserting into the slot, the flange having an internal bore for receiving the post, a retainer for engaging the arm member to retain it in the slot, and means for connecting the mounting ring to the end casing.

30. The assembly of claim 29 wherein the connecting means is at least one fastener extending through the retainer and the mounting ring and into the end casing.

31. The assembly of claim 29 wherein the retainer is in the form of a spring clip having a through opening for receiving the fastener.

32. The assembly of claim 31 wherein the spring clip engages the upper surface of the flange.

33. The assembly of claim 31 wherein the end casing has a bore formed therein, wherein the mounting ring comprises a boss having a opening extending therethrough, and wherein the fastener extends though the openings in the boss and the spring clip and into the bore in the end casing.

34. The assembly of claim 29 wherein there are a plurality of angularly-spaced slots formed in the mounting ring, and a plurality of arm members respectively extending in the slots.

35. The assembly of claim 34 further comprising a plurality of blades respectively connected to the arm members.

36. The assembly of claim 34 wherein there are a plurality of retainers respectively engaging the arm members.

37. The assembly of claim 29 wherein the mounting ring comprises a plurality of interconnected arcuate segments.

38. A fan assembly comprising a rotor end casing, a mounting ring having at least one slot and at least one opening formed therein, at least one post located in the slot, an arm member having a flange for inserting into the slot, the flange having an internal bore for receiving the post, a spring clip for engaging the arm member to retain it in the slot and having an opening formed therein, and connecting means extending through the openings in the mounting ring and the spring clip and into the end casing for connecting the mounting ring and the spring clip to the end casing.

39. The assembly of claim 38 wherein the connecting means is in the form of a fastener.

40. The assembly of claim 38 wherein a portion of the spring clip engages the upper surface of the flange.

41. The assembly of claim 38 wherein the end casing has a bore formed therein, wherein the mounting ring comprises a boss having a opening extending therethrough, and wherein the connecting means comprises a fastener extending though the openings in the boss and the spring clip, and into the bore in the end casing.

42. The assembly of claim 38 wherein there are a plurality of angularly-spaced slots formed in the mounting ring, and a plurality of arm members respectively extending in the slots.

43. The assembly of claim 42 further comprising a plurality of blades respectively connected to the arm members.

44. The assembly of claim 42 wherein there are a plurality of spring clips respectively engaging the arm members.

45. The assembly of claim 38 wherein the mounting ring is formed by a plurality of interconnected arcuate segments.

46. A fan assembly comprising a rotor end casing, a mounting ring having at a plurality of angularly-spaced slots formed therein, a plurality of arm members respectively extending in the slots, at least one post located in each slot, a plurality of arm members each having a flange for inserting into a corresponding slot, each flange having an internal bore for receiving a corresponding post, and means for connecting the mounting ring to the end casing.

47. The assembly of claim 46 further comprising a retainer for engaging each arm member to retain it in its corresponding slot.

48. The assembly of claim 47 wherein the connecting means is at least one fastener extending through the retainer and the mounting ring and into the end casing.

49. The assembly of claim 47 wherein the retainer is in the form of a spring clip having a through opening for receiving the fastener.

50. The assembly of claim 49 wherein a portion of the spring clip engages the upper surface of the flange.

51. The assembly of claim 49 wherein the end casing has a bore formed therein, wherein the mounting ring comprises a boss having a opening extending therethrough, and wherein the fastener extends though the openings in the boss and the spring clip and into the bore in the end casing.

52. The assembly of claim 46 further comprising a plurality of blades respectively connected to the arm members.

* * * * *